US006200103B1

(12) United States Patent
Bender

(10) Patent No.: US 6,200,103 B1
(45) Date of Patent: Mar. 13, 2001

(54) GAS LIFT PLUNGER HAVING GROOVES WITH INCREASED LIFT

(76) Inventor: Robert E. Bender, 7475 Rossman Gulch Rd., Morrison, CO (US) 80465

( * ) Notice: Subject to any disclaimer, the term of this patent is extended or adjusted under 35 U.S.C. 154(b) by 0 days.

(21) Appl. No.: 09/246,581

(22) Filed: Feb. 5, 1999

(51) Int. Cl.[7] ..... F04B 47/12

(52) U.S. Cl. ..... 417/56; 417/555.2; 92/162 R; 166/153

(58) Field of Search ..... 417/56, 57, 58, 417/59, 60, 555.1, 555.2; 92/162 R; 166/153, 155, 319, 320, 321, 322

(56) References Cited

U.S. PATENT DOCUMENTS

| | | | | |
|---|---|---|---|---|
| 1,922,396 | * | 8/1933 | Ricker | 417/56 |
| 2,276,109 | * | 3/1942 | Smith | 15/104.06 |
| 2,763,017 | * | 9/1956 | Redin | 15/104.06 |
| 3,352,212 | * | 11/1967 | Read | 417/56 |
| 4,410,300 | | 10/1983 | Yerian | 417/56 |
| 4,502,843 | | 3/1985 | Martin | 417/56 |
| 4,663,795 | * | 5/1987 | Neff | 15/104.06 |
| 5,253,713 | | 10/1993 | Gregg et al. . | |
| 5,427,504 | | 6/1995 | Dinning et al. . | |
| 6,038,725 | * | 3/2000 | Knapp | 166/153 |

FOREIGN PATENT DOCUMENTS

2051178 * 1/1981 (GB) ..... 166/155

OTHER PUBLICATIONS

WSPO20 Solid Steel Plunger Drawing.
Catalog Page Brush Plunger, Well Master Corporation, Lakewood, Colorado.
Catalog Page Solid Steel Plunger, Well Master Corporation, Lakewood, Colorado.
Avallone, Eugene et al., ed.; 1987; Marks'Standard Handbook for Mechanical Engineers; pp. 3–58 to 3–59.*

* cited by examiner

*Primary Examiner*—Charles G. Freay
*Assistant Examiner*—Cheryl J. Tyler
(74) *Attorney, Agent, or Firm*—Ancel W. Lewis, Jr.

(57) ABSTRACT

A plunger in a plunger lift system in an oil and gas well includes circumferential recessed surfaces that define grooves spaced along the plunger body. A curved convex surface or radius is formed between the lower extent of each recessed surface and the plunger body, and a sharp edge or corner connects the upper extent of each recessed surface to the plunger body. The depth of the grooves decreases and the spacing between the grooves decreases from the bottom to the top of the plunger. The shape, sizing and spacing of the grooves improves plunger lift and decreases liquid loss during plunger lift.

8 Claims, 2 Drawing Sheets

GAS LIFT PLUNGER HAVING GROOVES WITH INCREASED LIFT

TECHNICAL FIELD

This present invention relates to plunger lift systems for oil and gas wells, and more particularly to gas lift plungers with an improved gas seal.

BACKGROUND ART

Plunger lift systems are artificial lift systems for oil and gas wells. Plunger lift systems are used during the producing life of the well when the bottom hole pressure and the gas to liquid ratio will no longer support natural flow. A plunger lift system includes a tubing string in the well casing. The tubing string has a well valve and lubricator at the top and a spring assembly at the bottom, and an elongated cylindrical plunger that travels between the bottom and the top of the tubing string. The well is intermitted by shutting in the well for a selected time period to allow pressure build up and then opening the well valve for a selected period of time, allowing fluid to flow into the sales line. The plunger moves up the tubing string during the time the well valve is open, pushing a liquid slug to the top. When the well valve is closed the plunger falls back to the bottom of the tubing string. The open and closed times for the well valve are typically controlled by a programmable controller.

The gas lift plunger in a plunger lift system is the interface between the liquid slug above the plunger and the pressurized gases that push the plunger from below. Plungers are designed to minimize the downward flow of liquid and the upward flow of gas between the plunger and tubing string as the plunger travels up the tubing string. One type of plunger uses mechanical seals spaced along the cylindrical plunger body to seal between the plunger and the tubing string. U.S. Pat. No. 5,253,713 to Gregg et al. discloses a plunger with elastomeric seals. U.S. Pat. No. 5,427,504 discloses a plunger with sealing pads that are biased outwardly against the tubing string by springs. Plungers with mechanical seals provide efficient sealing between the plunger and the tubing string. However, plungers with mechanical seals have a plurality of parts, often making these plungers complex and expensive. These plungers also often require an internal bypass valve that must be opened for the plunger to fall back to the bottom of the tubing string.

Plungers for plunger lift systems have heretofore used the upward gas flow to seal between the plunger and tubing string. This type of plunger has a diameter slightly smaller than the diameter of the tubing string in order to allow liquid to flow upward between the plunger and tubing string while the well valve is closed. These plungers generally have a plurality of longitudinally spaced circumferential grooves spaced between cylindrical body sections of the peripheral surface of the plunger body. The grooves create a turbulent flow in gases flowing upwardly between the plunger and tubing string as the plunger is pushed up the tubing string, and thereby reduce the gas flow up and liquid flow down around the plunger. Prior known plungers have uniformly sized and uniformly shaped grooves uniformly spaced along the plunger body. The recessed surface of the grooves in the prior known plungers connects to the surface of the plunger body along sharp edges or corners. U.S. Pat. No. 4,410,300 to Yerian discloses a plunger with grooves having an asymmetrical V-shaped cross section. U.S. Pat. No. 4,502,843 to Martin discloses a plunger with grooves having a semicircular cross section. Plungers having grooves with a square or rectangular cross section have also been produced.

Plungers with gas flow seals are less complex and less expensive than plungers with mechanical seals. However, prior known gas flow-seal plungers are less efficient in sealing than plungers with mechanical seals.

DISCLOSURE OF THE INVENTION

A plunger for an oil or gas well is disclosed. The plunger has a cylindrical elongated plunger body with a top end and a bottom end. The plunger body includes a plurality of longitudinally spaced circumferential grooves defined by recessed surfaces interspersed between sections of the peripheral surface of the plunger body. A curved surface or radius connects a lower extent of the recess of each groove to a body section, and a sharp edge or corner connects an upper extent of the surface of the groove to the next higher body section. The cross section of each recess is a continuous curve or a plurality of lines connected by curves. The depth of the recesses decreases from the bottom to the top of the plunger. The length of the body sections between the recesses may also decrease from the bottom to the top of the plunger, thereby decreasing the distance between recesses. The shape, sizing and spacing of the recesses improves plunger lift and reduces the flow of liquid around the plunger.

BRIEF DESCRIPTION OF THE DRAWINGS

Details of this invention are described in connection with the accompanying drawings that bear similar reference numerals in which.

DETAILED DESCRIPTION OF THE INVENTION

Figure 1:
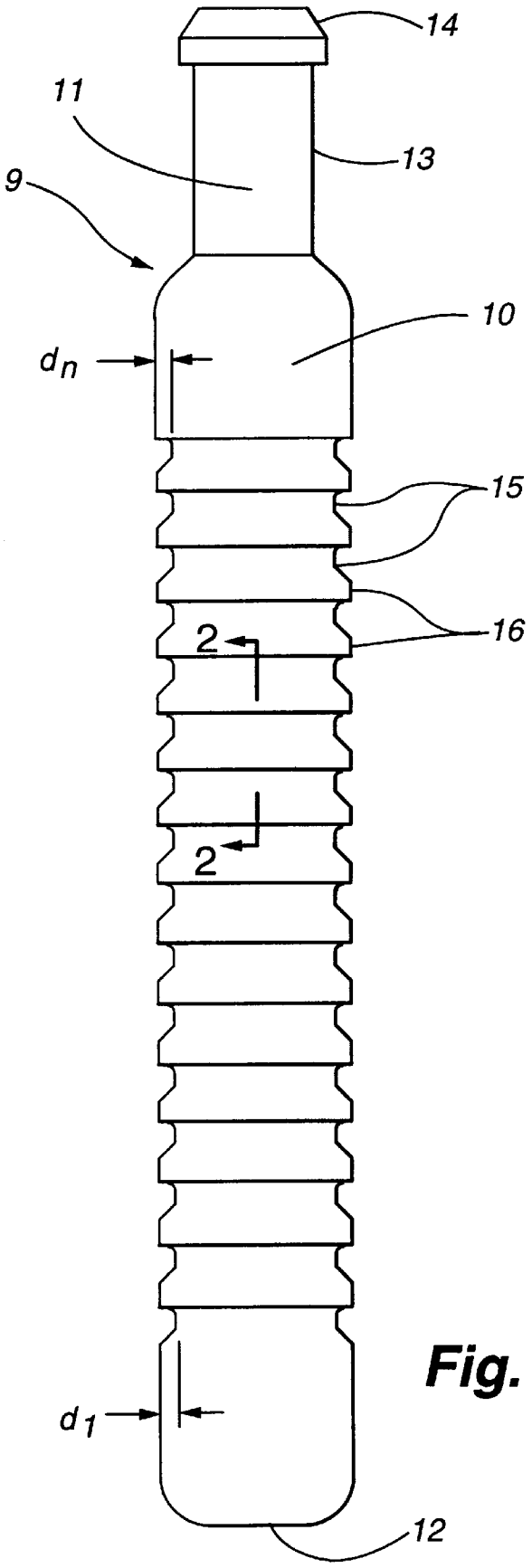
FIG. 1 is a side view of a plunger embodying features of the present invention.
Figure 2:
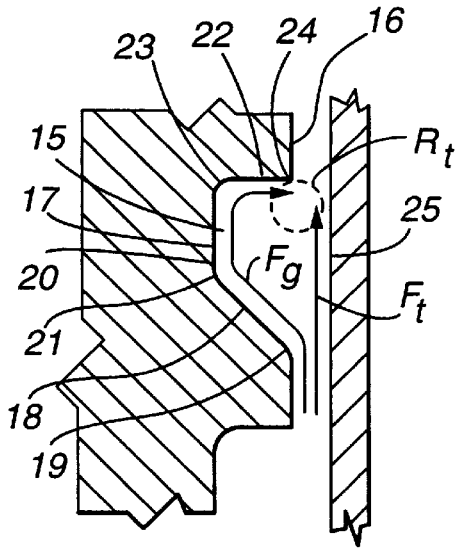
FIG. 2 is a cross sectional detail view of the plunger of FIG. 1 taken along line 2—2 with a section of the tubing string added.

Referring to FIGS. 1 and 2, the preferred embodiment of the present invention includes a gas lift plunger 9 shown as having a cylindrical, elongated plunger body 10 with a top portion or fishing neck portion 11 at the top and a flat bottom end 12. The plunger body 10 is sized to fit into a selected size tubing string with a selected clearance to allow liquid to flow upward during the time the well valve is closed.

Describing the specific embodiments herein chosen for illustrating the invention, certain terminology is used which will be recognized as being employed for convenience and having no limiting significance. For example, the terms "up", "down", "top", and "bottom" refer to the illustrated embodiment in its normal position of use. The terms "outward" and "inward" will refer to radial directions with reference to the central axis of the device. Further, all of the terminology above-defined includes. derivatives of the word specifically mentioned and words of similar import.

The fishing neck portion 11 has an exterior size and shape corresponding to a conventional oil and gas well plunger fishing neck. The fishing neck 11 has a lower portion 13, and an upper portion 14. The lower portion 13 is attached to the top of the plunger body 10 and is cylindrical with a first diameter significantly smaller than the plunger body diameter. The upper portion 14 attaches to the top of lower portion 13 and is button shaped with a diameter intermediate the first diameter and the plunger body diameter. The fishing neck 11 provides a means for engagement of a fishing tool for mechanical retrieval of the plunger from the tubing string.

The plunger body 10 includes a plurality of longitudinally spaced, circumferential grooves 15 that divide the peripheral surface of the plunger body 10 into a plurality of outer surface sections 16. Each groove 15 is defined by a recessed surface 17 having lower surface portion 18 connected to the upper extent of an outer surface section 16 by a convex curved surface or radius 19. The lower surface portion 18 extends upwardly and inwardly from convex curved surface or radius 19, forming a conic section. In the preferred embodiment, the lower surface portion 18 has an angle of substantially 45° relative to the body sections 16.

Each recessed surface 17 has an upwardly extending intermediate surface portion 20 connected to the upper extent of the lower section 18 by a first concave radius 21. An outwardly extending upper surface portion 22 of the recessed surface 17 is connected to the upper extent of the intermediate surface portion 20 by a second concave radius 23. A sharp edge or corner 24 connects the outer extent of the upper surface portion 22 to a body section 16. The first, second and third radiuses 19, 21 and 23, in the preferred embodiment, each have a radius of about one quarter the depth of the deepest groove 15.

Each groove 15 has a depth $d_i$, measured as the radial distance from the deepest part of the recessed surface 17 to the outer surface of the plunger body 10. In the preferred embodiment the depth $d_i$ for each groove 15 is the radial distance from the intermediate surface portion 20 to the outer surface sections 16. The subscript i denotes the number of the groove 15 from the bottom end 12, so that for the groove 15 closest to the bottom end 12, i=1, for the next groove 15, i=2, and so on. The depth of the grooves 15 decreases from the bottom to the top of the plunger body 10. The relationship of groove 15 depth may be expressed as $d_n > d_{n+1}$, where n is any selected groove 15.

Figure 3:
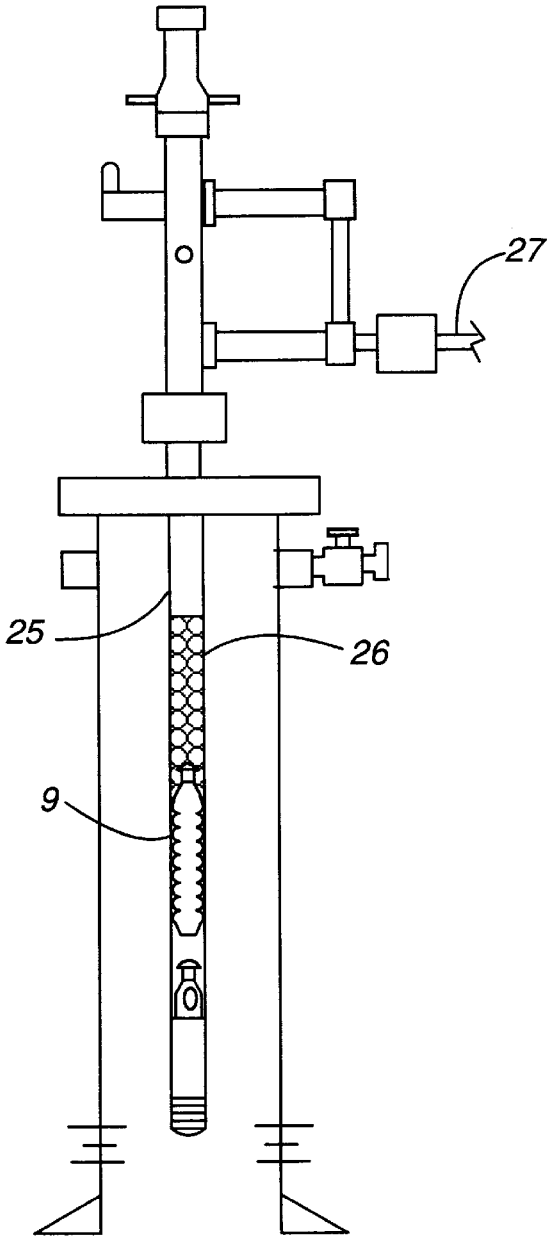
FIG. 3 is a schematic side view of a plunger lift system for an oil and gas well incorporating the plunger of FIG. 1.

Referring to FIG. 3, the gas below the plunger 9 must have sufficient pressure to overcome the weight of the plunger 9 and a liquid slug 26 on top of the plunger 9, and the sales line 27 pressure, in order to move the plunger up the tubing string 25. Due to the clearance between the plunger 9 and the tubing string 25 a flow passage is formed and some of the gas below the plunger 9 will flow up between the plunger 9 and the tubing string 25. As shown in FIG. 2, as this gas enters the groove 15, a first portion $F_t$ of the gas flows along the surface of the tubing string 25 and a second portion $F_g$ flows along the recessed surface 17. The convex radius 19 prevents or reduces separation of the second portion $F_g$ and the flow remains laminar. Similarly, the first concave radius 21 and second concave radius 23 reduce separation and turbulence in the second portion $F_g$ along recessed surface 17. The first portion $F_t$ and second portion $F_g$ of flowing gas meet at substantially a right angle at the corner 24, creating a turbulent flow region $R_t$ that inhibits liquid flow downward into the groove and inhibits gas flow upward out of the groove. The gas flowing up along the plunger 9 dissipates energy at each successive groove 15 so the depth of the grooves 15 is decreased to assure turbulence near each successive corner 24.

Figure 5:
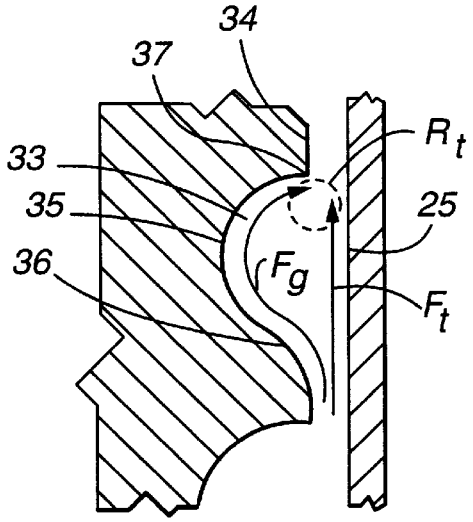
FIG. 5 is a cross sectional detail view of the plunger of FIG. 4 taken along line 5—5 with a section of the tubing string added.
Figure 4:
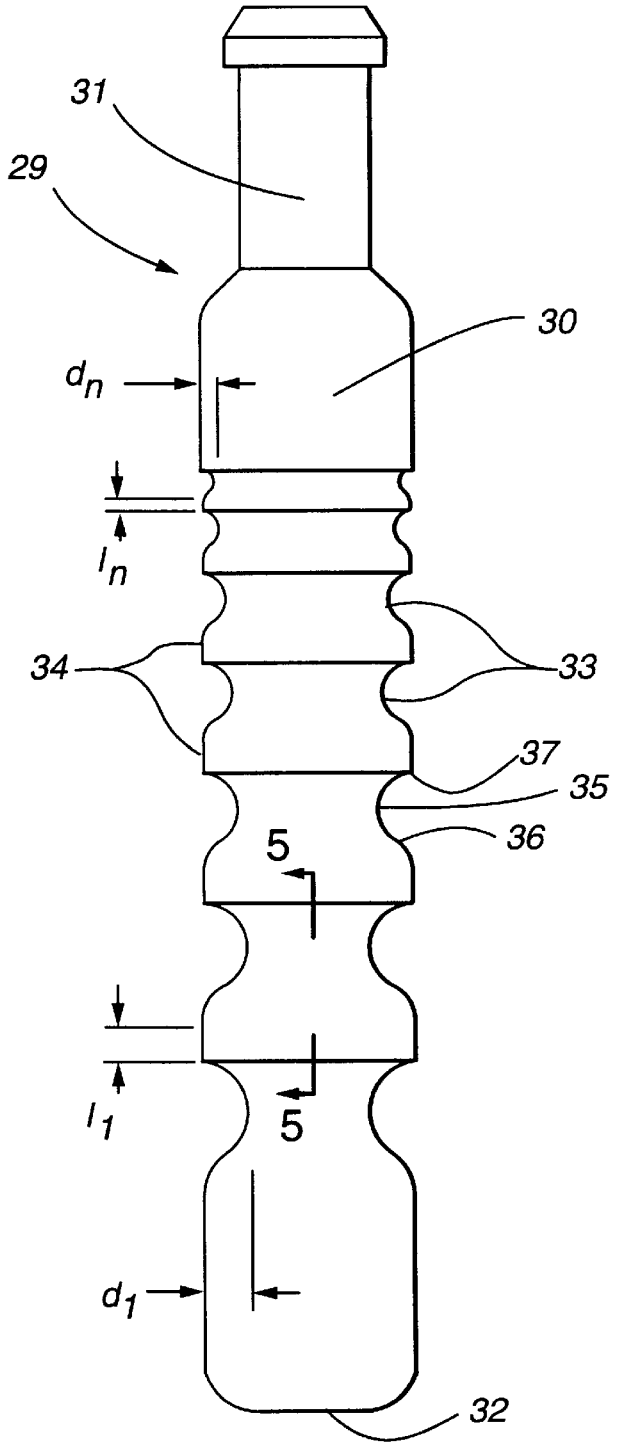
FIG. 4 is a side view of an alternative embodiment plunger embodying features of the present invention.

FIGS. 4 and 5 show an alternative embodiment plunger including a plunger 29 having a cylindrical, elongated plunger body 30 with a top member or fishing neck portion 31 at the top and a flat bottom end 32. The fishing neck portion 31 is substantially the same as fishing neck portion 11 described above. The plunger body 30 includes a plurality of longitudinally spaced, circumferential recessed surfaces 35 that define grooves 33 that divide the surface of the plunger body 30 into a plurality of outer surface sections 34.

Each recessed surface 35 connects at a lower extent along a convex outward radius 36 to an upper extent of a outer surface section 34 and connects at an upper extent at a sharp edge or corner 37 to a lower extent of a next outer surface section 34. The recessed surface 35 and radius 36 each have a cross section that is a curved arc and each cross section has the same radius. The cross section of the recessed surface 35 is an arc of about 150° and the cross section of the radius 36 is an arc of about 30°. The corner 37 is substantially a right angle.

As previously described, the depth $d_i$ of the grooves 33 decreases from the bottom to the top of the plunger body 30. The depth $d_i$ of each groove 33 is approximately equal to the radius of the recessed surface 35 so the distance between outer surface sections 34 decreases from the bottom to the top of the plunger body 30. In this alternative embodiment the length $l_i$ of the outer surface sections 34 decreases from the bottom to the top of the plunger body 30 and the grooves 33 become closer together.

As shown in FIG. 5, as this gas enters the groove 33, a first portion $F_t$ of the gas flows along the surface of the tubing string 25 and a second portion $F_g$ flows along the recessed surface 35. The radius 36 prevents or reduces separation of the second portion $F_g$ and the flow remains laminar. Similarly, the curvature of recessed surface 35 reduces separation and turbulence in the second portion $F_g$ along recessed surface 35. The first portion $F_t$ and second portion $F_g$ of flowing gas meet at substantially a right angle at the corner 37, creating a turbulent flow region $R_t$ that inhibits liquid flow downward into the groove and inhibits gas flow upward out of the groove. The gas flowing up along the plunger 29 dissipates energy at each successive groove 33 so the depth of the grooves 33 is decreased to assure turbulence near each successive corner 37. Similarly, due to the dissipation of energy, the flow between the outer surface sections 34 and tubing string 25 reverts to a laminar flow over a shorter distance higher on the plunger 9, and the grooves 33 may be more closely spaced.

Although the present invention has been described with a certain degree of particularity, it is understood that the present disclosure has been made by way of example and that changes in details of structure may be made without departing from the spirit thereof.

What is claimed is:

1. A plunger for movement up and down in a tubing string in a plunger lift system for an oil and gas well comprising:

an elongated plunger body having a peripheral surface and a space between the tubing string and said peripheral surface, the tubing string and said peripheral surface defining a flow passage along the entire length of said plunger body along which an upflowing gas moves, said plunger body having a plurality of longitudinally spaced circumferential grooves in said peripheral surface, each said groove being defined by a recessed surface connected at a lower extent by a convex curved surface to said peripheral surface and connected at an upper extent at a corner to said peripheral surface to provide laminar entry of the upflowing gas into said groove and turbulent exit of the upflowing gas out of said groove.

2. The plunger as set forth in claim 1 wherein said grooves successively decrease in depth from the bottom to the top of said plunger body.

3. The plunger as set forth in claim 1 wherein said grooves are progressively closer together from the bottom to the top of said plunger body.

4. The plunger as set forth in claim 1 wherein said recessed surfaces each have a cross section consisting of a plurality of lines connected by curves.

5. The plunger as set forth in claim 1 wherein said recessed surfaces each have a lower portion extending inwardly and upwardly from said convex curved surface, an upwardly extending intermediate portion connected at a lower extent by a first concave radius to an upper extent of said lower portion, and an outwardly extending upper portion connected at an inner extent by a second concave radius to an upper extent of said intermediate portion and connected at an outer extent to said corner.

6. The plunger as set forth in claim 1 wherein said recessed surfaces each have a cross section that is a curved arc.

7. A plunger for movement up and down in a tubing string in a plunger lift system for an oil and gas well comprising:

an elongated plunger body with a space between the tubing string and a peripheral surface-of said plunger body, the tubing string and said peripheral surface defining a flow passage along which an upflowing gas moves, said plunger body having a plurality of longitudinally spaced circumferential grooves in said peripheral surface, each said groove being defined by a recessed surface connected at a lower extent by a convex curved surface to said peripheral surface and connected at an upper extent at a corner to said peripheral surface to provide laminar entry of the upflowing gas into said groove and turbulent exit of the upflowing gas out of said groove, each said recessed surface having a lower portion extending inwardly and upwardly from said convex curved surface, an upwardly extending intermediate portion connected at a lower extent by a first concave radius to an upper extent of said lower portion, and an outwardly extending upper portion connected at an inner extent by a second concave radius to an upper extent of said intermediate portion and connected at an outer extent to said corner, said recessed surfaces successively decreasing in depth from the bottom to the top of said plunger body.

8. A plunger for movement up and down in a. tubing string in a plunger lift system for an oil and gas well comprising:

an elongated plunger body with a space between the tubing string and a peripheral surface of said plunger body, the tubing string and said peripheral surface defining a flow passage along which an upflowing gas. moves, said plunger body having a plurality of longitudinally spaced circumferential grooves in said peripheral surface, each said groove being defined by a recessed surface connected at a lower extent by a convex curved surface to said peripheral surface and connected at an upper extent at a corner to said peripheral surface to provide laminar entry of the upflowing gas into said groove and turbulent exit of the upflowing gas out of said groove, said recessed surfaces each having a cross section shaped as a curved arc, said recessed surfaces successively decreasing in depth from the bottom to the top of said plunger body, said recessed surfaces being spaced progressively closer together from the bottom to the top of said plunger body.

* * * * *